US006203004B1

(12) United States Patent
Spatafora et al.

(10) Patent No.: US 6,203,004 B1
(45) Date of Patent: Mar. 20, 2001

(54) DEVICE FOR FEEDING BLANKS ON A PACKING MACHINE

(75) Inventors: Mario Spatafora, Bologna; Franco Carini, Granarolo Emilia, both of (IT)

(73) Assignee: G. D Societa' per Azioni, Pomponia (IT)

( * ) Notice: Subject to any disclaimer, the term of this patent is extended or adjusted under 35 U.S.C. 154(b) by 0 days.

(21) Appl. No.: 09/352,064

(22) Filed: Jul. 14, 1999

(30) Foreign Application Priority Data

Jul. 15, 1998 (IT) ..... BO98A0430

(51) Int. Cl.[7] ..... B65H 7/02

(52) U.S. Cl. ..... 271/31; 271/31.1; 271/150; 198/461.2; 198/462.3

(58) Field of Search ..... 271/31, 155, 31.1, 271/150, 265.01; 198/461.2, 462.3, 461.3, 464.1, 572, 471.1, 573

(56) References Cited

U.S. PATENT DOCUMENTS

| | | | | |
|---|---|---|---|---|
| 3,894,732 | * | 7/1975 | Muller | 271/10 |
| 4,323,230 | * | 4/1982 | Rising | 271/12 |
| 4,582,315 | * | 4/1986 | Scarpa et al. | 271/150 |
| 4,869,486 | * | 9/1989 | Scarpa et al. | 271/3.1 |
| 4,954,203 | * | 9/1990 | Matsumoto | 156/361 |
| 5,029,834 | | 7/1991 | Boldrini et al. . | |
| 5,131,899 | * | 7/1992 | Nagahashi et al. | 493/317 |
| 5,244,199 | * | 9/1993 | Wood | 271/150 |
| 5,292,114 | * | 3/1994 | McConnell | 271/34 |

FOREIGN PATENT DOCUMENTS

| | | |
|---|---|---|
| 37 23 589 | 1/1989 | (DE) . |
| 42 17 178 | 11/1993 | (DE) . |
| 1 010 428 | 11/1965 | (GB) . |

* cited by examiner

*Primary Examiner*—Christopher P. Ellis
*Assistant Examiner*—Khoi H. Tran
(74) *Attorney, Agent, or Firm*—Marshall, O'Toole, Gerstein, Murray & Borun

(57) ABSTRACT

A method and device for feeding blanks on a packing machine, whereby a conveyor feeds along a horizontal path a succession of blanks positioned perpendicular to the path; the path terminating at a pickup station having a stop surface defined by a frame, which has a withdrawal opening closed partly by fixed teeth and is moved in a direction substantially parallel to the path by the thrust exerted by the blanks and in opposition to a sensor for regulating a traveling speed of the conveyor to keep the thrust exerted by the blanks on the frame constant.

7 Claims, 3 Drawing Sheets

1
2
3
4
5
6
7
8
9
10
11
12
13
14
15
16
17
18
19
20
21
22
24
25
27
28
29
33
34
35
36
37
38
40
41
42
43
44
48
63
64
S1
S2

DEVICE FOR FEEDING BLANKS ON A PACKING MACHINE

The present invention relates to a device for feeding blanks on a packing machine.

The present invention may be used to advantage on cigarette packing machines, to which the following description refers purely by way of example.

BACKGROUND OF THE INVENTION

Known cigarette packing machines normally comprise a blank feed device of the type described in U.S. Pat. No. 5,029,834, wherein a substantially vertical feed channel houses a stack of blanks and terminates with a stop surface defined by a frame having a withdrawal opening closed partly by fixed teeth to retain the blanks inside the channel. A suction pickup device engages the withdrawal opening cyclically to withdraw and feed the bottom blank in the stack to a follow-up operating unit on the packing machine.

In blank feed devices of the above type, the blanks are fed along the feed channel by force of gravity, so that the force exerted by the blanks on the stop surface frame depends on the weight of the stack (i.e. on the number of blanks in the stack) and on the friction forces between the blanks and the walls of the feed channel.

In actual use, the number of blanks in the stack inside the feed channel varies continually, on account of the blanks being withdrawn substantially continuously from the feed channel and being loaded into the feed channel in stacks. Moreover, the friction forces between the blanks and the walls of the feed channel also vary continually on account of inevitable minor differences (within given tolerances) in the size of the blanks.

Consequently, the force exerted by the blanks on the stop surface frame also varies continually, as opposed, preferably, to remaining substantially constant at a given value not so high as to prevent the suction pickup device from withdrawing the blanks smoothly, yet not so low as to prevent the blanks from being packed and aligned properly inside the feed channel.

DE-A1-3723589 discloses a device for feeding paper foils, the device comprising a pickup station having a stop roller; a conveyor for feeding a succession or stack of paper foils to the pickup station and along a given horizontal path; pickup means located at the pickup station to withdraw an end paper foil contacting the stop roller; a force sensor connected to the stop roller to determine a value of a thrust exerted by the paper foils on the stop roller; and control means connected to the force sensor and to the conveyor to maintain the thrust constant by regulating a traveling speed of the conveyor. The pickup means comprise a pair of cooperating rollers, which are arranged below the stop roller and engage the end paper foil for feeding same to further processing means.

The known device described above, the stop roller is necessarily arranged contacting a central portion of the surface of the end paper foil to be withdrawn. The stop roller being arranged centrally of the end paper foil implies withdrawing the end paper foil by sliding same along the adjacent paper foil and in contact with the stop roller which, especially when using paper foils with shining surfaces such as cigarette packet blanks, may damage the foils.

SUMMARY OF THE INVENTION

It is an object of the present invention to provide a device for feeding blanks on a packing machine, designed to eliminate the aforementioned drawback, and which at the same time is straightforward and cheap to implement.

According to the present invention, there is provided a device for feeding blanks on a packing machine, the device comprising a pickup station having a stop means; a powered conveyor for feeding a succession of said blanks to the pickup station and along a given horizontal path; pickup means located at said pickup station to withdraw an end blank contacting said stop means; a force sensor connected to said stop means to determine a value of a thrust exerted by said blanks on said stop means; and control means connected to said force sensor and to said conveyor to maintain said thrust constant by regulating a traveling speed of said conveyor; the device being characterized in that said stop means comprises a stop surface defined by a frame having a withdrawal opening closed partly by fixed teeth; said frame being mounted movably in an adjusting direction substantially parallel to said path and in opposition to said force sensor.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
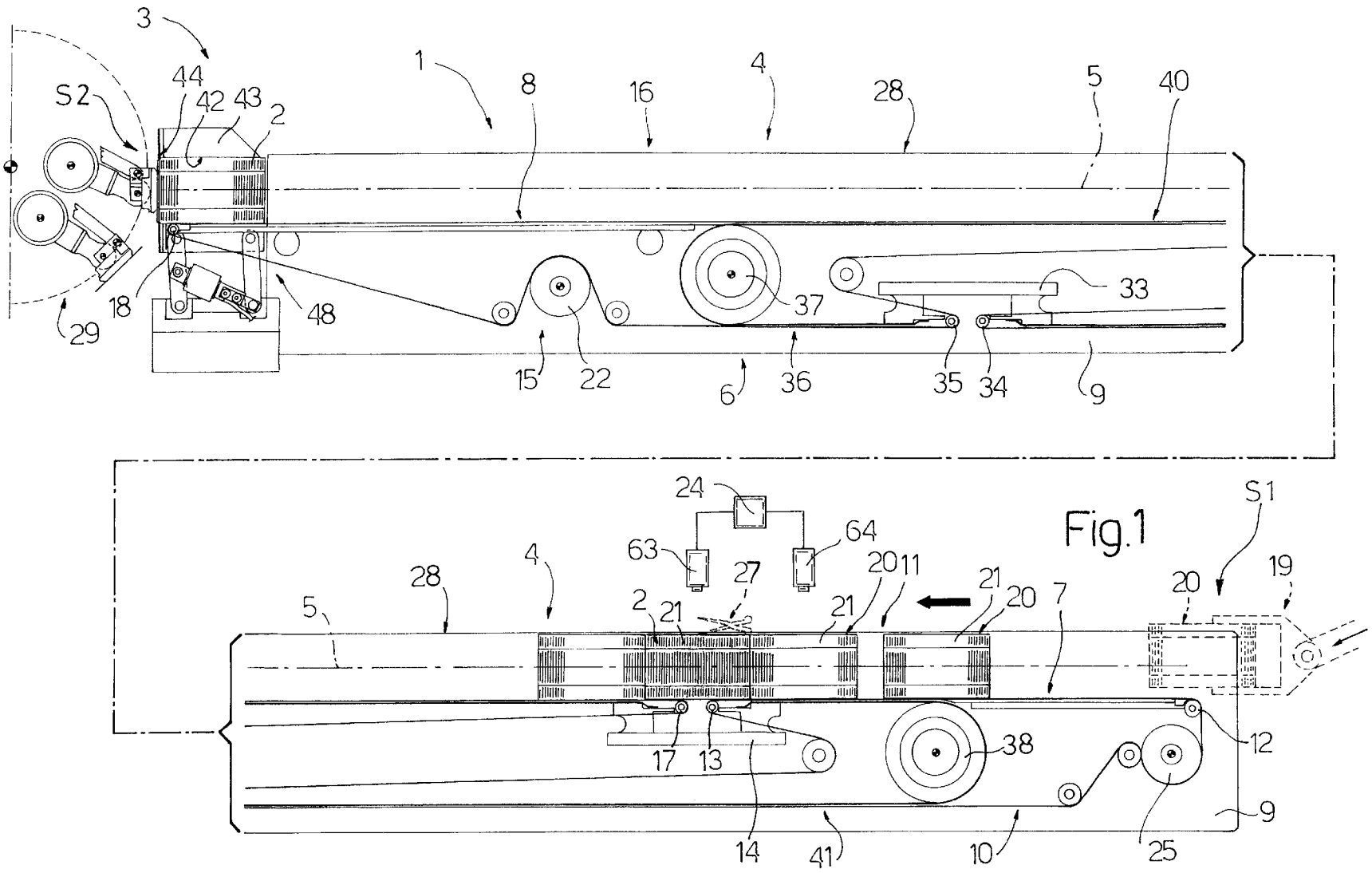
FIG. 1 shows a schematic side view, with parts removed for clarity, of a preferred embodiment of the device according to the present invention.

Number 1 in FIG. 1 indicates as a whole a device for feeding blanks 2 on a packing machine 3, in particular a packing machine for producing rigid packets of cigarettes (not shown).

Device 1 comprises a store 4 for housing blanks 2, and which has a horizontal axis 5 (parallel to the FIG. 1 plane), and in turn comprises an input station S1 and a pickup station S2 at opposite ends of store 4.

Store 4 comprises a conveying device 6 extending along axis 5 between input station S1 and pickup station S2 to feed blanks 2 on edge, i.e. perpendicular to axis 5, along store 4.

Conveying device 6 comprises two belt conveyors 7 and 8 fitted to a frame 9 and arranged in series to feed blanks 2 along store 4. Conveyor 7 comprises a return branch 10 and a conveying branch 11, which extend between an end pulley 12 in a fixed position at input station S1, and an opposite end pulley 13 fitted to a carriage 14 running along axis 5.

Conveyor 8 comprises a return branch 15 and a conveying branch 16, which extend between an end pulley 17 fitted to carriage 14 and facing pulley 13, and an opposite end pulley 18 in a fixed position at pickup station S2.

At input station S1, a known supply device 19 is provided for feeding conveyor 7 with blanks 2 arranged in orderly groups 20, each of which is enclosed in a respective retaining band 21.

Belt conveyor 8 is driven by a pulley 22 connected to a motor 23 controlled by a control unit 24, which, as explained in detail later on, provides for operating conveyor 8 at a speed V1 depending on the pickup speed of blanks 2 from pickup station S2.

Belt conveyor 7 is driven by a pulley 25 connected to a motor 26 controlled by control unit 24, so as to operate conveyor 7 at a speed V2 greater than speed V1 and so pack groups 20 one against the other along store 4. Such packing obviously involves sliding the packed groups 20 with respect to conveyor 7.

Figure 5:
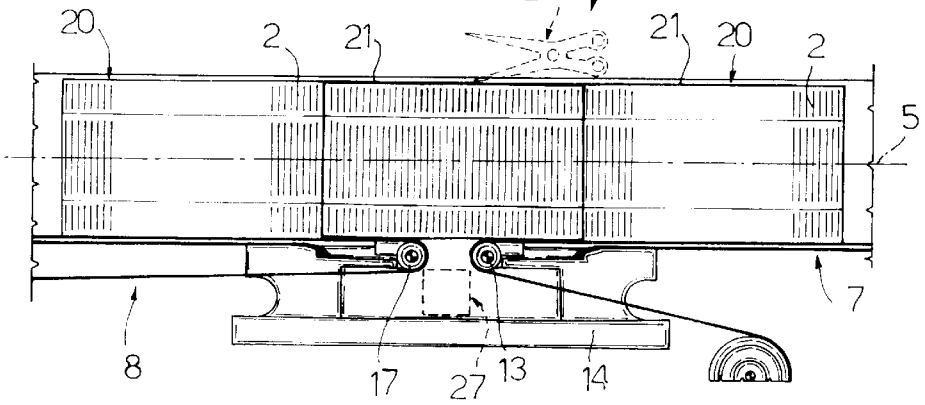
FIG. 5 shows a larger-scale side view of a further detail of FIG. 1.

As shown in FIG. 5, carriage 14 supports a known device 27 (shown schematically) for removing bands 21, and which engages each group 20 of blanks to remove respective band 21 from group 20 and form, in store 4, a succession 28 of blanks 2 terminating at pickup station S2.

Figure 3:
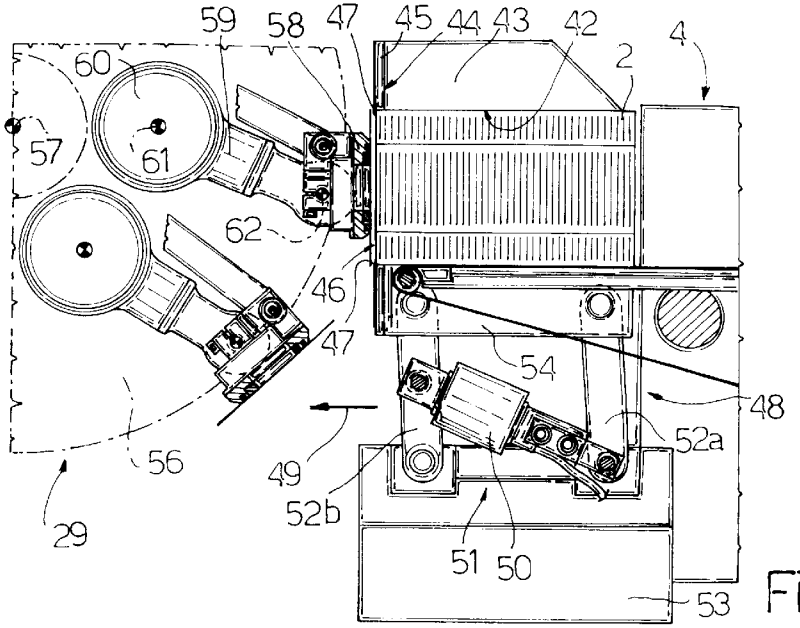
FIG. 3 shows a larger-scale side view of a detail in FIG. 1.

As shown in FIG. 3, at pickup station S2, packing machine 3 comprises a known pickup device 29 for withdrawing blanks 2 one by one from pickup station S2.

Figure 2:
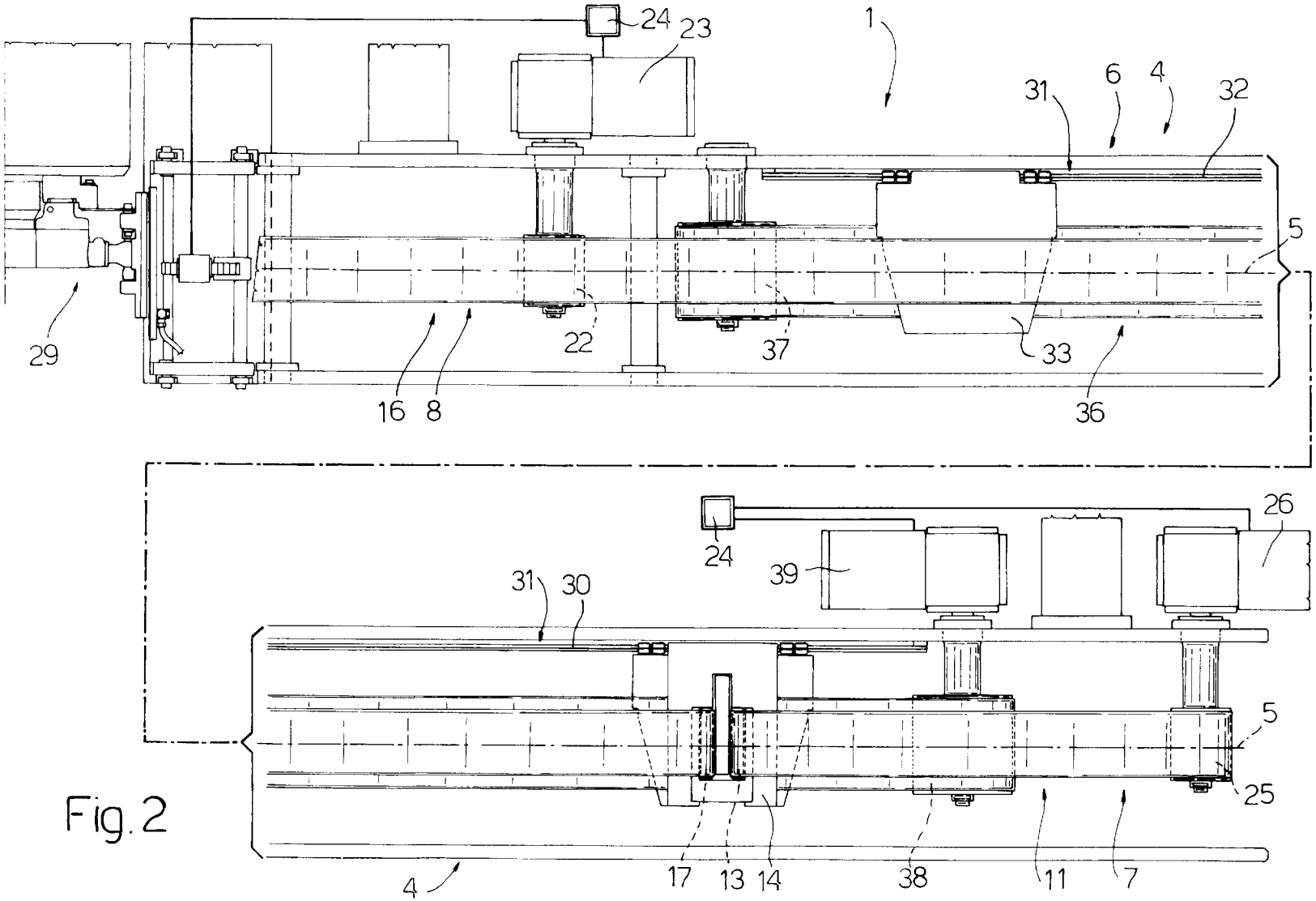
FIG. 2 shows a plan view of FIG. 1.

As shown in FIG. 2, carriage 14 runs along a rail 30 of a fixed guide 31 fitted to frame 9 and extending parallel to axis 5. Guide 31 also comprises a rail 32 along which runs a further carriage 33 supporting, facing each other, two intermediate pulleys 34 and 35 of respective conveyors 7 and 8. Carriages 14 and 33 are connected mechanically to a belt conveyor 36 having an idle end pulley 37 and an opposite end pulley 38 powered by a motor 39 controlled by control unit 24. Pulleys 37 and 38 define a top conveying portion 40 and a bottom conveying portion 41 parallel to and facing each other and extending along axis 5. Top conveying portion 40 is fitted with carriage 14, and bottom conveying portion 41 is fitted with carriage 33.

As pulley 38 is rotated about its axis by control unit 24, carriages 14 and 33 perform the same movement but in opposite directions to maintain a constant total length of conveyors 7 and 8 at all times, and so prevent harmful stretching of the belts of conveyors 7 and 8.

In actual use, carriage 14 fitted with device 27 for removing bands 21 is normally maintained stationary in a given operating position along axis 5; and, when a group 20 enclosed in a respective band 21 is fed onto carriage 14 and in a predetermined position with respect to device 27, device 27 engages group 20 to remove respective band 21 in known manner.

In the course of the above removal operation, carriage 14 is fed along store 4 in time with group 20 to keep band 21 of group 20 and device 27 stationary with respect to each other in said predetermined position.

Once band 21 is removed, device 27 releases group 20, and carriage 14 is restored to the initial operating position to await the next group 20 enclosed in a respective band 21.

As shown clearly in FIG. 1, conveyors 7 and 8 rest in sliding manner on top conveying portion 40 of conveyor 36 along a portion of respective conveying portions 11 and 16.

At pickup station S2, conveyor 8 feeds succession 28 of blanks 2 into a channel 42, which is defined at the bottom by conveyor 8 and at the top and sides by a number of fixed sections 43, and terminates with a stop surface 44 perpendicular to axis 5 and against which succession 28 exerts a thrust F depending on the traveling speed of conveyor 8.

In an embodiment not shown, channel 42 has a variable section, which gets smaller towards stop surface 44 to guide and set blanks 2 in a given transverse position.

Stop surface 44 is defined by a frame 45, which comprises a withdrawal opening 46 closed partly by fixed teeth 47, and is fitted to frame 9 by means of a structure 48 deformable in a deformation direction 49 substantially parallel to axis 5 and in opposition to a force sensor 50, in particular a load cell.

Structure 48 comprises a pair of articulated parallelograms 51, each of which comprises a pair of parallel, opposite cranks 52*a*, 52*b* hinged at one end to a fixed base 53 forming part of frame 9, and at the opposite end to a connecting rod 54 supporting frame 45 and positioned horizontally beneath conveying portion 16 of conveyor 8.

The two parallelograms 51 are made integral with each other by two cross members 55, one of which extends between the two hinge points of cranks 52*a* to base 53, and the other between two corresponding intermediate points of the two cranks 52*b*.

Force sensor 50 is interposed between the two cross members 55 to oppose deformation of the two parallelograms 51 as of a given configuration assumed by parallelograms 51 in response to a zero thrust F.

Sensor 50 is therefore capable of instantaneously determining the value of thrust F exerted by succession 28 of blanks 2 on frame 45, and to communicate the value of thrust F to control unit 24 to which it is connected.

Pickup device 29 is of known type and provides for withdrawing each blank 2 singly through opening 46 in frame 45, and for feeding blank 2 to a packing wheel (not shown) of packing machine 3.

Device 29 comprises a wheel 56 rotating continuously (clockwise in FIG. 1) about a respective fixed axis 57 perpendicular to axis 5, and supporting a number of pneumatic gripping heads 58 arranged about axis 57 and connected to wheel 56 via the interposition of respective arms 59, each of which is hinged to wheel 56 by a pin 60 to oscillate, with respect to wheel 56, about a respective axis 61 parallel to axis 57.

Each gripping head 58 is in turn hinged to respective arm 59 to oscillate, with respect to arm 59, about a respective axis 62 parallel to axis 57.

Operation of feed device 1 will now be described as of the instant (shown in FIG. 1) in which store 4 contains succession 28 of blanks 2 extending between stop surface 44 and carriage 14, and a given number of groups 20 of blanks 2 upstream from carriage 14.

Pickup device 29 withdraws blanks 2 one by one from pickup station S2 at a speed depending on the speed of packing machine 3; and, at the same time, control unit 24 controls motor 23 to so regulate the traveling speed V1 of conveyor 8 as to maintain the value of thrust F constant and equal (within a given adjustment range) to a predetermined value.

As already stated, control unit 24 controls motor 26 to operate conveyor 7 at a speed V2 greater than speed V1 of conveyor 8, so as to pack groups 20 one against the other along store 4.

At intervals depending on the speed of conveyor 8, and therefore on the pickup speed of pickup device 29, supply device 19 is activated by control unit 24 to feed a group 20 of blanks 2 onto conveyor 7 at input station S1.

A sensor, e.g. an optical sensor, 63 is connected to control unit 24 and located over said operating position of carriage 14 to indicate to control unit 24 when a group 20 enclosed in a respective band 21 is fed onto carriage 14 in said predetermined position with respect to device 27.

A further sensor, e.g. an optical sensor, 64 is connected to control unit 24 and located over said operating position of carriage 14 to indicate to control unit 24 whether the group 20 enclosed in band 21 and located on carriage 14 is packed between succession 28 of blanks 2 and at least one further group 20 enclosed in a respective band 21.

Only when a group 20 is located on carriage 14 and packed between succession 28 of loose blanks 2 and at least one further group 20 enclosed in a respective band 21, does control unit 24 activate device 27 to remove band 21 from the group 20 on carriage 14 as described previously.

Feed device 1 therefore provides for removing bands 21 in the best possible conditions, by device 27, during removal of band 21, being maintained in a constant fixed position with respect to respective group 20.

Moreover, once band 21 is removed, respective group 20 remains stable (i.e. the position of blanks 2 in group 20 remains unchanged) by group 20 being packed between succession 28 of loose blanks 2 and at least one further group 20 enclosed in a respective band 21.

Finally, the thrust F exerted by blanks 2 on stop surface frame 45 is substantially constant and equal to a precise given value, which is not so high as to prevent suction pickup device 29 from withdrawing blanks 2 easily, and is not so low as to prevent blanks 2 from being packed and positioned properly inside channel 42.

Said given value of thrust F is normally calculated by control unit 14 according to the operating speed of packing machine 3 and the type of blank 2 used.

Figure 4:
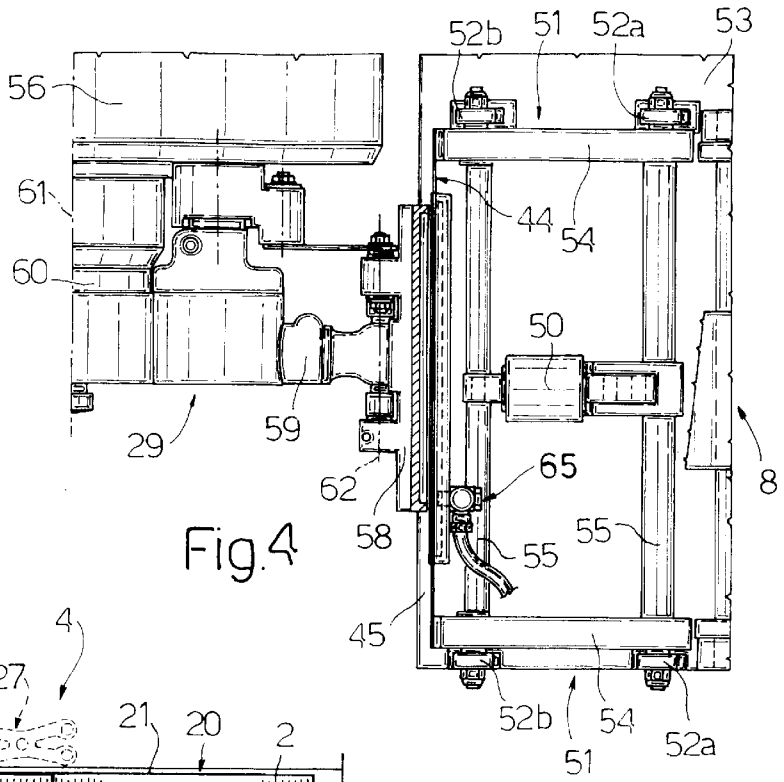
FIG. 4 shows a plan view, with parts removed for clarity, of the FIG. 3 detail.

As shown in FIG. 4, a separating device 65 is provided close to frame 45 to blow air between the blanks 2 adjacent to frame 45 and so assist withdrawal by pickup device 29 of the blank 2 engaging opening 46.

In an embodiment not shown, force sensor 50 is connected to a mechanical stop device to limit to a safe value the maximum load to which sensor 50 is subjected.

In a further embodiment not shown, conveyor 8 is fitted with a vibrating device, which acts on succession 28 of blanks 2 to assist packing and alignment of blanks 2 along store 4 and, particularly, inside channel 42.

What is claimed is:

1. A device for feeding blanks on a packing machine, the device comprising a pickup station having a stop means; a powered conveyor for feeding a succession of said blanks to the pickup station and along a given horizontal path; pickup means located at said pickup station to withdraw an end blank contacting said stop means; a force sensor connected to said stop means to determine a value of a thrust exerted by said blanks on said stop means; and control means connected to said force sensor and to said conveyor to maintain said thrust constant by regulating a traveling speed of said conveyor; the device being characterized in that said stop means comprises a stop surface defined by a frame having a withdrawal opening closed partly by fixed teeth; said frame being mounted movably in an adjusting direction substantially parallel to said path and in opposition to said force sensor.

2. A device as claimed in claim 1, further comprising a structure deformable substantially in said adjusting direction and supporting said frame; said force sensor being connected to said structure to oppose deformation of the structure.

3. A device as claimed in claim 2, wherein said structure comprises at least one articulated parallelogram having a pair of parallel opposite cranks hinged at one end to a fixed frame and at the opposite end to a connecting rod connected rigidly to said stop surface; said force sensor being interposed between said pair of cranks.

4. A device as claimed in claim 3, wherein said connecting rod is positioned horizontally beneath said conveyor.

5. A device as claimed in claim 1, further comprising a store for housing said blanks, and which is located along said path and has said pickup station and an input station at opposite ends of said path; and a supply device for supplying said input station with said blanks positioned perpendicular to the axis of the store and arranged in orderly groups, each group enclosed in a respective retaining band; said conveyor being connected to said store to feed said groups along the store towards said pickup station so as to pack said groups one against the other; and removing means being provided to remove said bands and form, inside said store, a succession of blanks terminating at said pickup station.

6. A device as claimed in claim 5, wherein said conveyor comprise a first and a second belt conveyor arranged in series to feed the blanks along the store; said first belt conveyor terminating at said pickup station; and said second belt conveyor commencing at said input station.

7. A device as claimed in claim 6, wherein said first belt conveyor comprises first drive means for moving the first belt conveyor at a first speed depending on a pickup speed of the blanks from said pickup station; said second belt conveyor comprising second drive means for moving the second belt conveyor at a second speed greater than said first speed.

* * * * *